US008490900B2

(12) United States Patent
Evans

(10) Patent No.: US 8,490,900 B2
(45) Date of Patent: Jul. 23, 2013

(54) UNBONDED LOOSEFILL INSULATION SYSTEM

(75) Inventor: Michael E. Evans, Granville, OH (US)

(73) Assignee: Owens Corning Intellectual Captial, LLC, Toledo, OH (US)

( * ) Notice: Subject to any disclaimer, the term of this patent is extended or adjusted under 35 U.S.C. 154(b) by 233 days.

(21) Appl. No.: 12/924,939

(22) Filed: Oct. 8, 2010

(65) Prior Publication Data

US 2011/0084091 A1 Apr. 14, 2011

Related U.S. Application Data

(63) Continuation-in-part of application No. 12/831,786, filed on Jul. 7, 2010, now Pat. No. 7,980,498, which is a continuation of application No. 11/581,661, filed on Oct. 16, 2006, now Pat. No. 7,819,349.

(60) Provisional application No. 61/250,244, filed on Oct. 9, 2009.

(51) Int. Cl.
*B02C 19/00* (2006.01)

(52) U.S. Cl.
USPC ..... 241/18; 241/24.29; 241/605

(58) Field of Classification Search
USPC ..... 241/60, 605, 18, 24.29
See application file for complete search history.

(56) References Cited

U.S. PATENT DOCUMENTS

| | | | |
|---|---|---|---|
| 2,869,793 | A | 1/1959 | Montgomery |
| 4,134,508 | A | 1/1979 | Burdett, Jr. |
| 4,344,580 | A | 8/1982 | Hoshall et al. |
| 4,777,086 | A | 10/1988 | Madden et al. |
| 5,462,238 | A | 10/1995 | Smith et al. |
| 5,683,810 | A | 11/1997 | Babbitt et al. |
| 5,786,082 | A | 7/1998 | Evans et al. |
| 6,109,488 | A | 8/2000 | Horton |
| 6,562,257 | B1 | 5/2003 | Chen et al. |
| 7,354,466 | B2 | 4/2008 | Dunning et al. |
| 2006/0231651 | A1 | 10/2006 | Evans et al. |
| 2008/0087751 | A1 | 4/2008 | Johnson et al. |
| 2008/0089748 | A1 | 4/2008 | Johnson et al. |

*Primary Examiner* — Mark Rosenbaum
(74) *Attorney, Agent, or Firm* — Fraser Clemens Martin & Miller LLC; Charles F. Charpie

(57) ABSTRACT

An unbonded loosefill insulation system configured to provide blown loosefill insulation material is provided. The system includes a blowing insulation machine configured to condition and distribute loosefill insulation from a package of compressed loosefill insulation. The blowing insulation machine is further configured to have pre-set and fixed operating parameters. An unbonded loosefill insulation material is configured for use with the blowing insulation machine. The pre-set and fixed operating parameters of the blowing insulation machine are tuned to combine with the unbonded loosefill insulation materials to provide blown loosefill insulation material having specific insulative values.

9 Claims, 6 Drawing Sheets
(2 of 6 Drawing Sheet(s) Filed in Color)

UNBONDED LOOSEFILL INSULATION SYSTEM

RELATED APPLICATIONS

This application is a continuation-in-part of pending U.S. application Ser. No. 12/831,786, filed Jul. 7, 2010, which is a continuation of U.S. application Ser. No. 11/581,661, filed Oct. 16, 2006, now U.S. Pat. No. 7,819,349. This application also claims the benefit of U.S. Provisional Patent Application No. 61/250,244, filed Oct. 9, 2009, all of the disclosures of which are incorporated herein by reference.

BACKGROUND

A frequently used insulation product is unbonded loosefill insulation. In contrast to the unitary or monolithic structure of insulation batts or blankets, unbonded loosefill insulation is a multiplicity of discrete, individual tufts, cubes, flakes or nodules. Unbonded loosefill insulation is usually applied to buildings by blowing the unbonded loosefill insulation into an insulation cavity, such as a wall cavity or an attic of a building. Typically unbonded loosefill insulation is made of glass fibers although other mineral fibers, organic fibers, and cellulose fibers can be used.

Unbonded loosefill insulation, also referred to as blowing wool, is typically compressed and encapsulated in a bag. The compressed unbonded loosefill insulation and the bag form a package. Packages of compressed unbonded loosefill insulation are used for transport from an insulation manufacturing site to a building that is to be insulated. The bags can be made of polypropylene or other suitable materials. During the packaging of the unbonded loosefill insulation, it is placed under compression for storage and transportation efficiencies. The compressed unbonded loosefill insulation can be packaged with a compression ratio of at least about 10:1. The distribution of unbonded loosefill insulation into an insulation cavity typically uses a loosefill blowing machine that feeds the unbonded loosefill insulation pneumatically through a distribution hose. Loosefill blowing machines can have a chute or hopper for containing and feeding the compressed unbonded loosefill insulation after the package is opened and the compressed unbonded loosefill insulation is allowed to expand.

It would be advantageous if the loosefill blowing machines could be easier to use.

SUMMARY

The above objects as well as other objects not specifically enumerated are achieved by an unbonded loosefill insulation system configured to provide blown loosefill insulation material. The system includes a blowing insulation machine configured to condition and distribute loosefill insulation from a package of compressed loosefill insulation. The blowing insulation machine is further configured to have pre-set and fixed operating parameters. An unbonded loosefill insulation material is configured for use with the blowing insulation machine. The pre-set and fixed operating parameters of the blowing insulation machine are tuned to combine with the unbonded loosefill insulation materials to provide blown loosefill insulation material having specific insulative values.

According to this invention there is also provided a method of providing blown loosefill insulation material. The method includes the steps of providing an unbonded loosefill insulation system including a blowing insulation machine configured to condition and distribute loosefill insulation from a package of compressed loosefill insulation, the blowing insulation machine further configured to have pre-set and fixed operating parameters and an unbonded loosefill insulation material configured for use with the blowing insulation machine, fixing the operating parameters of the blowing insulation machine, feeding the unbonded loosefill insulation material into the blowing insulation machine, conditioning the unbonded loosefill insulation material within the blowing insulation machine and distributing the conditioned unbonded loosefill insulation material into an airstream. The pre-set and fixed operating parameters of the blowing insulation machine are tuned to combine with the unbonded loosefill insulation materials to provide blown loosefill insulation material having specific insulative values.

According to this invention there is also provided an unbonded loosefill insulation system configured to provide blown loosefill insulation material. The unbonded loosefill insulation system includes a blowing insulation machine configured to condition and distribute loosefill insulation from a package of compressed loosefill insulation. The blowing insulation machine is further configured to provide non-adjustable operating parameters to a machine user. An unbonded loosefill insulation material is configured for use with the blowing insulation machine. The non-adjustable operating parameters of the blowing insulation machine are tuned to combine with the unbonded loosefill insulation materials to provide blown loosefill insulation material having specific insulative values.

Various objects and advantages of this invention will become apparent to those skilled in the art from the following detailed description of the preferred embodiment, when read in light of the accompanying drawings.

BRIEF DESCRIPTION OF THE DRAWINGS

The patent or application file may contain one or more drawings executed in color and/or one or more photographs. Copies of this patent or patent application publication with color drawing(s) and/or photograph(s) will be provided by the Office upon request and payment of the necessary fee.

DETAILED DESCRIPTION OF THE INVENTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with embodiments of the present invention, the description and figures disclose unbonded loosefill insulation systems. The unbonded loosefill insulation systems include a loosefill blowing machine and an associated unbonded loosefill insulation material. Generally, the operating parameters of the loosefill blowing machine are tuned to the insulative characteristics of the associated unbonded loosefill insulation material such that the resulting blown unbonded loosefill insulation material provides improved insulative values. The term "loosefill blowing machine", as used herein, is defined to mean any structure, device or mechanism configured to condition and deliver insulation material into an airstream. The term "loosefill insulation material", as used herein, is defined to any conditioned insulation materials configured for distribution in an airstream. The term "unbonded", as used herein, is defined to mean the absence of a binder. The term "finely conditioned", as used herein, is defined to mean the shredding of unbonded loosefill insulation material to a desired density prior to distribution into an airstream.

Figure 1:
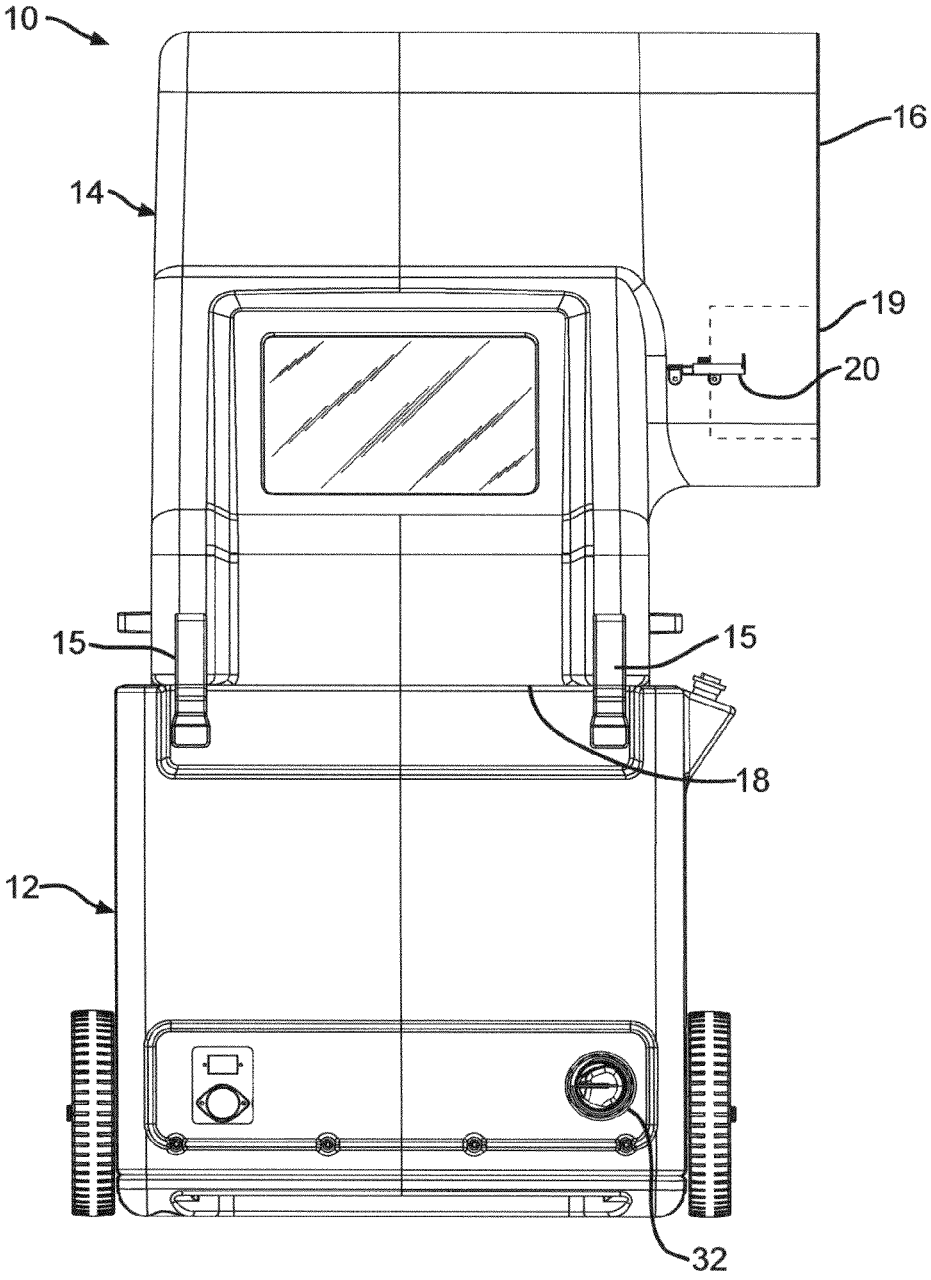
FIG. 1 is a front view in elevation of a loosefill blowing machine.
Figure 2:
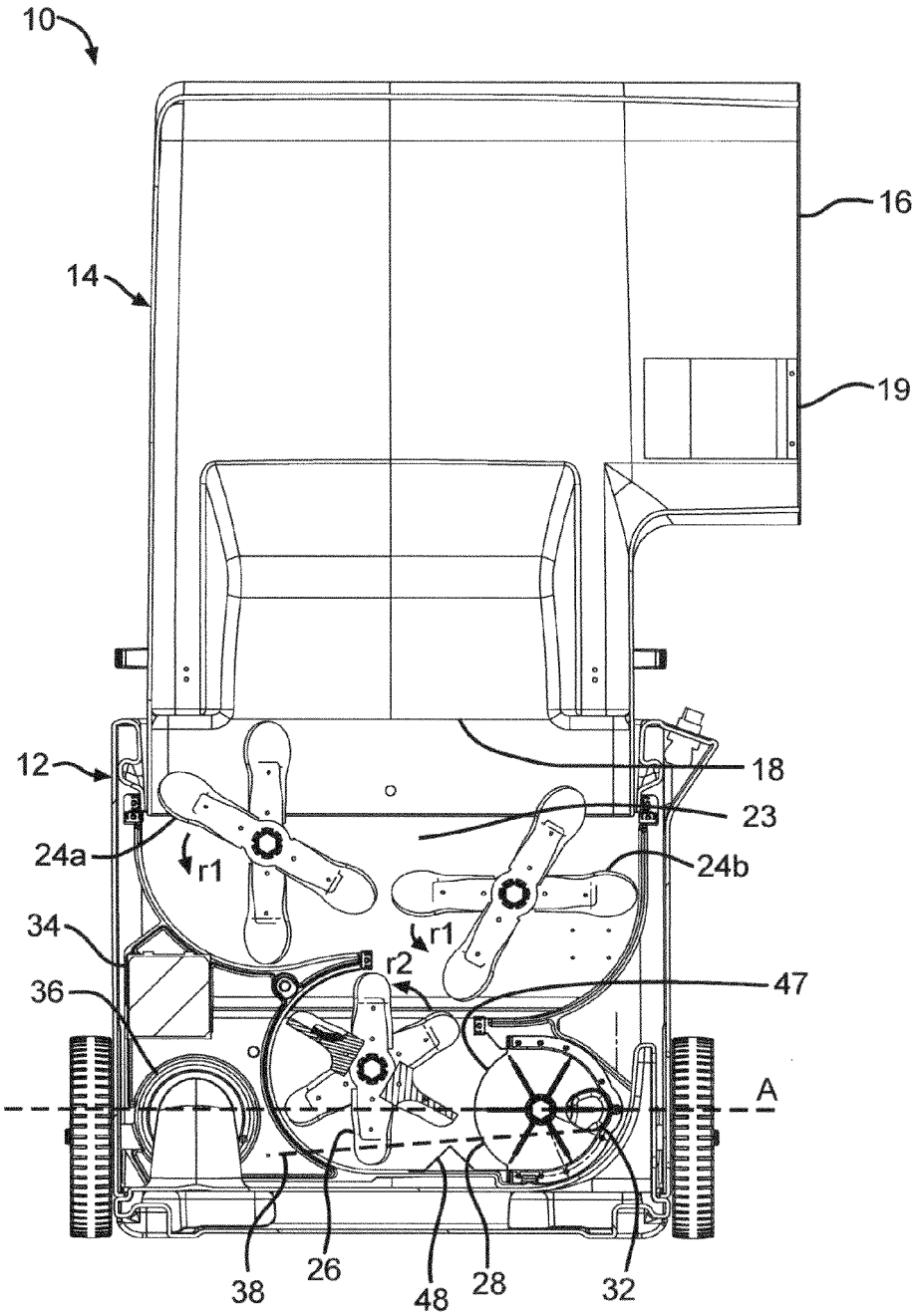
FIG. 2 is a front view in elevation, partially in cross-section, of the loosefill blowing machine of FIG. 1.
Figure 3:
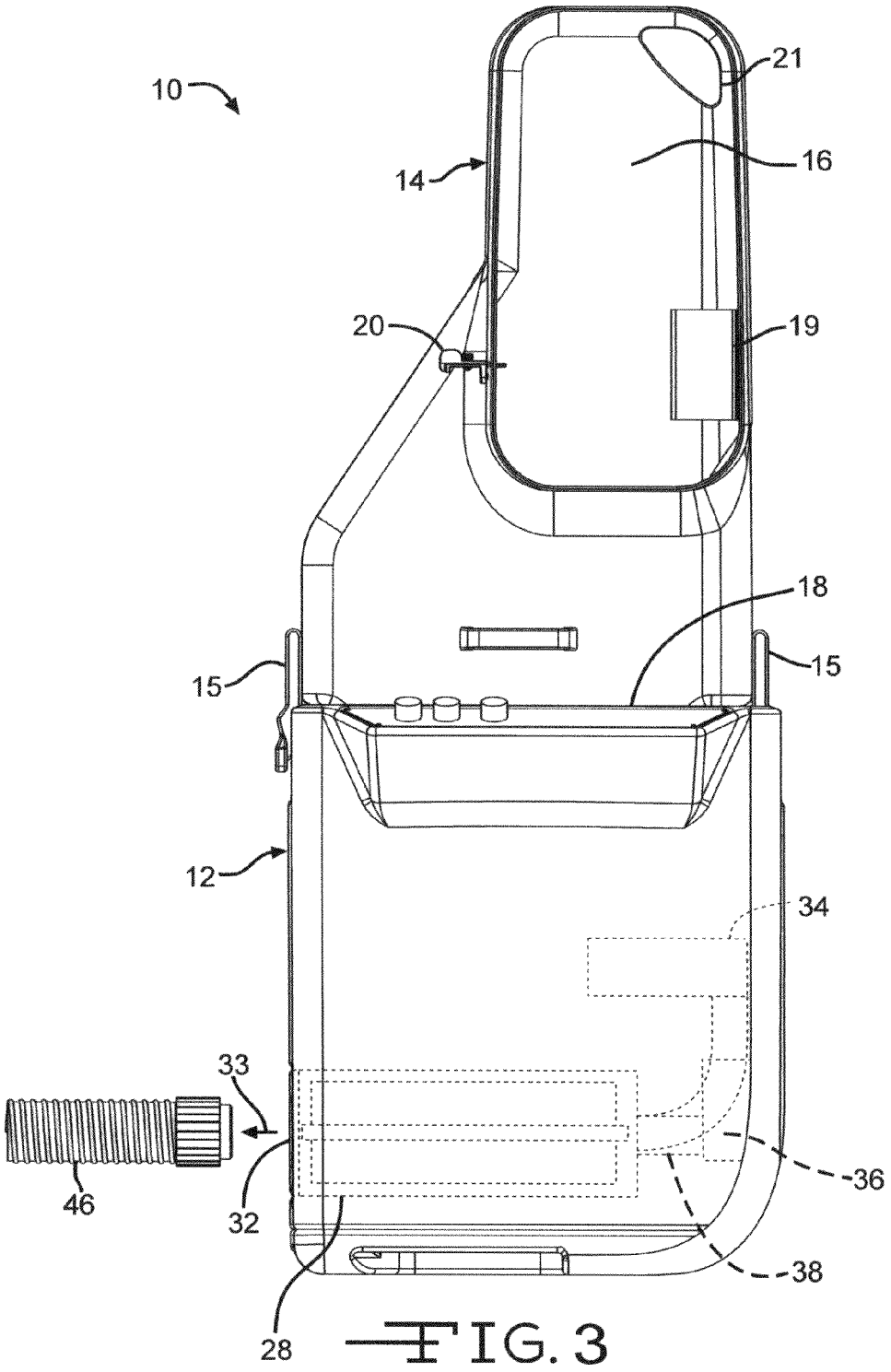
FIG. 3 is a side view in elevation of the loosefill blowing machine of FIG. 1.

One example of a loosefill blowing machine, configured for distributing compressed unbonded loosefill insulation material (hereafter "loosefill material"), is shown at 10 in FIGS. 1-3. The loosefill blowing machine 10 includes a lower unit 12 and a chute 14. The lower unit 12 can be connected to the chute 14 by a plurality of fastening mechanisms 15 configured to readily assemble and disassemble the chute 14 to the lower unit 12. As further shown in FIGS. 1-3, the chute 14 has an inlet end 16 and an outlet end 18.

The chute 14 is configured to receive loosefill material and introduce the loosefill material to a shredding chamber 23 as shown in FIG. 2. Optionally, the chute 14 can include a handle segment 21, as shown in FIG. 3, to facilitate easy movement of the blowing insulation machine 10 from one location to another. However, the handle segment 21 is not necessary to the operation of the loosefill blowing machine 10.

As further shown in FIGS. 1-3, the chute 14 can include an optional guide assembly 19 mounted at the inlet end 16 of the chute 14. The guide assembly 19 is configured to urge a package of loosefill material against an optional cutting mechanism 20, as shown in FIGS. 1 and 3, as the package moves into the chute 14.

As shown in FIG. 2, the shredding chamber 23 is mounted at the outlet end 18 of the chute 14. In the illustrated embodiment, the shredding chamber 23 includes a plurality of low speed shredders 24*a* and 24*b* and an agitator 26. The low speed shredders, 24*a* and 24*b*, are configured to shred and pick apart the loosefill material as the loosefill material is discharged from the outlet end 18 of the chute 14 into the lower unit 12. Although the loosefill blowing machine 10 is shown with a plurality of low speed shredders, 24*a* and 24*b*, any type of separator, such as a clump breaker, beater bar or any other mechanism that shreds and picks apart the loosefill material can be used.

Referring again to FIG. 2, the agitator 26 is configured to finely condition the loosefill material for distribution into an airstream. In the illustrated embodiment, the agitator 26 is positioned beneath the low speed shredders 24*a* and 24*b*. In other embodiments, the agitator 26 can be positioned in any desired location relative to the low speed shredders, 24*a* and 24*b*, sufficient to receive the loosefill material from the low speed shredders, 24*a* and 24*b*, including the non-limiting example of horizontally adjacent to the shredders, 24*a* and 24*b*. In the illustrated embodiment, the agitator 26 is a high speed shredder. Alternatively, any type of shredder can be used, such as a low speed shredder, clump breaker, beater bar or any other mechanism configured to finely condition the loosefill material and prepare the loosefill material for distribution into an airstream.

In the embodiment illustrated in FIG. 2, the low speed shredders, 24*a* and 24*b*, rotate at a lower speed than the agitator 26. The low speed shredders, 24*a* and 24*b*, rotate at a speed of about 40-80 rpm and the agitator 26 rotates at a speed of about 300-500 rpm. In other embodiments, the low speed shredders, 24*a* and 24*b*, can rotate at a speed less than or more than 40-80 rpm, provided the speed is sufficient to shred and pick apart the loosefill material. The agitator 26 can rotate at a speed less than or more than 300-500 rpm provided the speed is sufficient to finely condition the loosefill material and prepare the loosefill material for distribution into an airstream.

Referring again to FIG. 2, a discharge mechanism 28 is positioned adjacent to the agitator 26 and is configured to distribute the finely conditioned loosefill material in an airstream. In this embodiment, the finely conditioned loosefill material is driven through the discharge mechanism 28 and through a machine outlet 32 by an airstream provided by a blower 36 mounted in the lower unit 12. The airstream is indicated by an arrow 33 as shown in FIG. 3. In other embodiments, the airstream 33 can be provided by other methods, such as by a vacuum, sufficient to provide an airstream 33 driven through the discharge mechanism 28. In the illustrated embodiment, the blower 36 provides the airstream 33 to the discharge mechanism 28 through a duct 38, shown in phantom in FIG. 2 from the blower 36 to the discharge mechanism 28. Alternatively, the airstream 33 can be provided to the discharge mechanism 28 by other structures, devices or mechanisms, including the non-limiting examples of a hose or pipe, sufficient to provide the discharge mechanism 28 with the airstream 33.

The shredders, 24*a* and 24*b*, agitator 26, discharge mechanism 28 and the blower 36 are mounted for rotation and driven by a motor 34. The mechanisms and systems for driving the shredders, 24*a* and 24*b*, agitator 26, discharge mechanism 28 and the blower 36 will discussed in more detail below.

In operation, the chute 14 guides the loosefill material to the shredding chamber 23. The shredding chamber 23 includes the low speed shredders, 24*a* and 24*b*, configured to shred and pick apart the loosefill material. The shredded loosefill material drops from the low speed shredders, 24*a* and 24*b*, into the agitator 26. The agitator 26 finely conditions the loosefill material for distribution into the airstream 33 by further shredding the loosefill material. The finely conditioned loosefill material exits the agitator 26 and enters the discharge mechanism 28 for distribution into the airstream 33 caused by the blower 36. The airstream 33, with the finely conditioned loosefill material, exits the machine 10 at a machine outlet 32 and flows through a distribution hose 46, as shown in FIG. 3, toward the insulation cavity, not shown.

Referring again to FIG. 2, the discharge mechanism 28 is configured to distribute the finely conditioned loosefill material into the airstream 33. In the illustrated embodiment, the discharge mechanism 28 is a rotary valve. Alternatively, the discharge mechanism 28 can be other mechanisms including staging hoppers, metering devices, or rotary feeders, sufficient to distribute the finely conditioned loosefill material into the airstream 33.

Referring again to FIG. 2, the low speed shredders, 24*a* and 24*b*, rotate in a counter-clockwise direction r1 (as shown in FIG. 2) and the agitator 26 rotates in a counter-clockwise direction r2 (also shown in FIG. 2). Rotating the low speed shredders, 24*a* and 24*b*, and the agitator 26 in the same counter-clockwise direction allows the low speed shredders, 24*a* and 24*b*, and the agitator 26 to shred and pick apart the loosefill material while substantially preventing an accumulation of unshredded or partially shredded loosefill material in the shredding chamber 23. In other embodiments, the low speed shredders, 24*a* and 24*b*, and the agitator 26 each could rotate in a clock-wise direction or the low speed shredders, 24*a* and 24*b*, and the agitator 26 could rotate in different directions provided the relative rotational directions allow finely conditioned loosefill material to be fed into the discharge mechanism 28 while preventing a substantial accumulation of unshredded or partially shredded loosefill material in the shredding chamber 23.

Referring again to FIG. 2, the discharge mechanism 28 has a side inlet 47. The side inlet 47 is configured to receive the finely conditioned loosefill material as it is fed from the agitator 26. In the illustrated embodiment, the agitator 26 is positioned to be adjacent to the side inlet 47 of the discharge mechanism 28. In other embodiments, a low speed shredder 24, or a plurality of shredders 24 or agitators 26, or other shredding mechanisms can be adjacent to the side inlet 47 of the discharge mechanism or in other suitable positions.

As shown in FIG. 2, an optional choke 48 can be positioned between the agitator 26 and the discharge mechanism 28. The choke 48 is configured to redirect heavier clumps of loosefill material past the side inlet 47 of the discharge mechanism 28 and back to the low speed shredders, 24*a* and 24*b*, for further conditioning. The cross-sectional shape and height of the choke 47 can be configured to control the conditioning properties of the loosefill material entering the side inlet 47 of the discharge mechanism 28. While the illustrated embodiment of the choke 48 is shown as having a triangular cross-sectional shape, it should be appreciated that the choke 48 can have any cross-sectional shape and height sufficient to achieve the desired conditioning properties of the loosefill material entering the side inlet 47 of the discharge mechanism 28.

Referring again to FIG. 2, the lower unit 12 includes the blower 36, the duct 38 extending from the blower 36 to the discharge mechanism 28, the motor 34, the low speed shredders, 24*a* and 24*b* and the agitator 26. The lower unit 12 also includes a first drive system (not shown) and a second drive system (not shown). Generally, the first drive system is configured to drive the agitator 26 and also configured to drive the second drive system. The second drive system is configured to drive the low speed shredders, 24*a* and 24*b*, and the discharge mechanism 28.

The first drive system includes a plurality of drive sprockets, idler sprockets, tension mechanisms and a drive chain (for purposes of clarity none of these components are shown). The first drive system components are rotated by the motor 34, which, in turn causes rotation of the agitator.

Referring again to FIG. 2, the second drive system includes a plurality of drive sprockets, idler sprockets, tension mechanisms and a drive chain (also for purposes of clarity none of these components are shown). The second drive system components are rotated by the first drive system, which, in turn causes rotation of the first low speed shredder 24*a*, the second low speed shredder 24*b* and rotation of the discharge mechanism 28.

In the embodiment illustrated in FIG. 2, the first and second drive systems are configured such that the motor 34 drives each of the shredders, 24*a* and 24*b*, the agitator 26 and the discharge mechanism 28. In other embodiments, each of the shredders, 24*a* and 24*b*, the agitator 26 and the discharge mechanism 28 can be provided with its own motor.

In the illustrated embodiment, the motor 34 driving the first and second drive systems is configured to operate on a single 15 ampere, 110 volt a.c. power supply. In other embodiments, other power supplies can be used.

Referring again to FIG. 2 and as discussed above, the blower 36 provides the airstream to the discharge mechanism 28 through the duct 38 connecting the blower 36 to the discharge mechanism 28. In the illustrated embodiment, the blower 36 is a commercially available component, such as the non-limiting example of model 119419-00 manufactured by Ametek, Inc., headquartered in Paoli, Pa., although other blowers can be used.

Referring again to FIG. 2, the motor 34, configured to drive the first and second drive systems is controlled by a first controller (not shown). The first controller is configured to control the rotational speed of the motor 34 at a fixed rotational speed such that the resulting rotational speed of the low speed shredders, 24*a* and 24*b*, the agitator 26 and the discharge mechanism 28 are also fixed. The first controller can be any structure, device or mechanism sufficient to control the rotational speed of the motor 34 at a fixed rotational speed. As a result of the fixed rotational speed of the low speed shredders, 24*a* and 24*b*, the agitator 26 and the discharge mechanism 28, the flow rate of the finely conditioned loosefill material through the loosefill blowing machine 10 is also at a fixed level.

Referring again to FIG. 2, the blower 36, configured to provide the airstream 33 to the discharge mechanism 28 through a duct 38, is controlled by a second controller (not shown). The second controller is configured to control the operation of the blower 36 such that the resulting flow rate of the airstream from the blower 36 to the discharge mechanism 28 is fixed at a desired flow rate level. The second controller can be any structure, device or mechanism sufficient to control the rotational speed of the blower 36 at a fixed rotational speed. As a result of the fixed rotational speed of the blower 36, the flow rate of the airstream 33 through the loosefill blowing machine 10 is also at a fixed level.

While the embodiment of the loosefill blowing machine 10 has been described above as having various components operating at certain fixed rotational speeds, it should be appreciated that in other embodiments, the fixed rotational speeds can be at other rotational levels.

Figure 4:
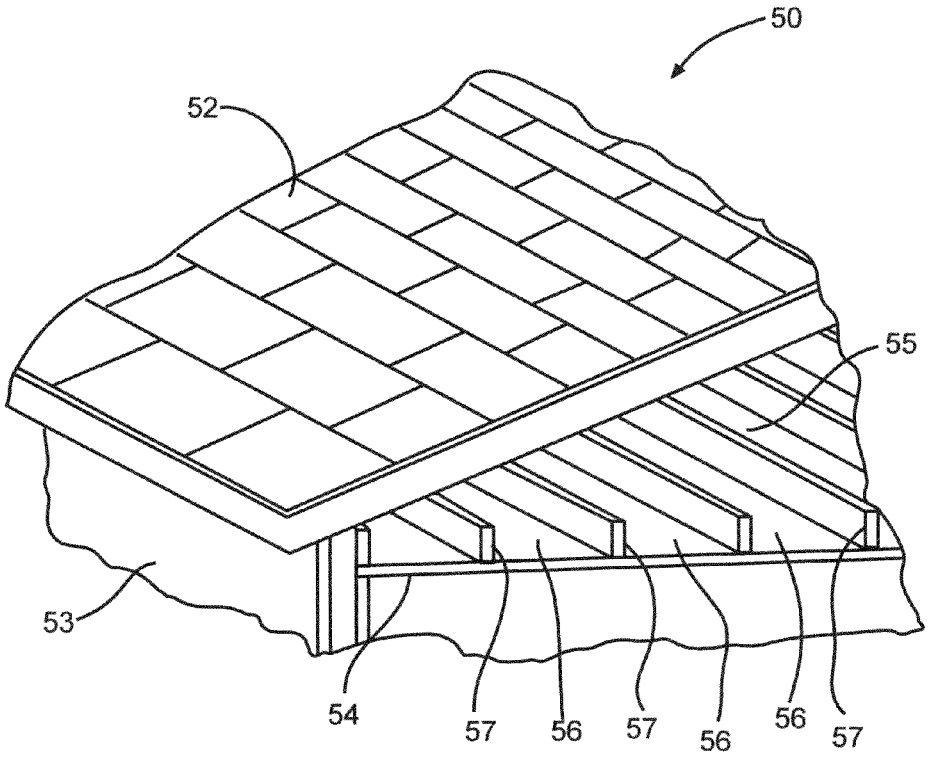
FIG. 4 is a perspective view of a building having an attic with insulation cavities.

Referring now to FIG. 4, one example of a building having insulation cavities is illustrated at 50. The building 50 includes a roof deck 52, exterior walls 53 and an internal ceiling 54. An attic space 55 is formed internal to the building 50 by the roof deck 52, exterior walls 53 and the internal ceiling 54. A plurality of structural members 57 positioned in the attic space 5 and above the internal ceiling 54 defines a plurality of insulation cavities 56. The insulation cavities 56 can be filled with finely conditioned loosefill material distributed by the loosefill blowing machine 10 through the distribution hose 46.

Figure 5:
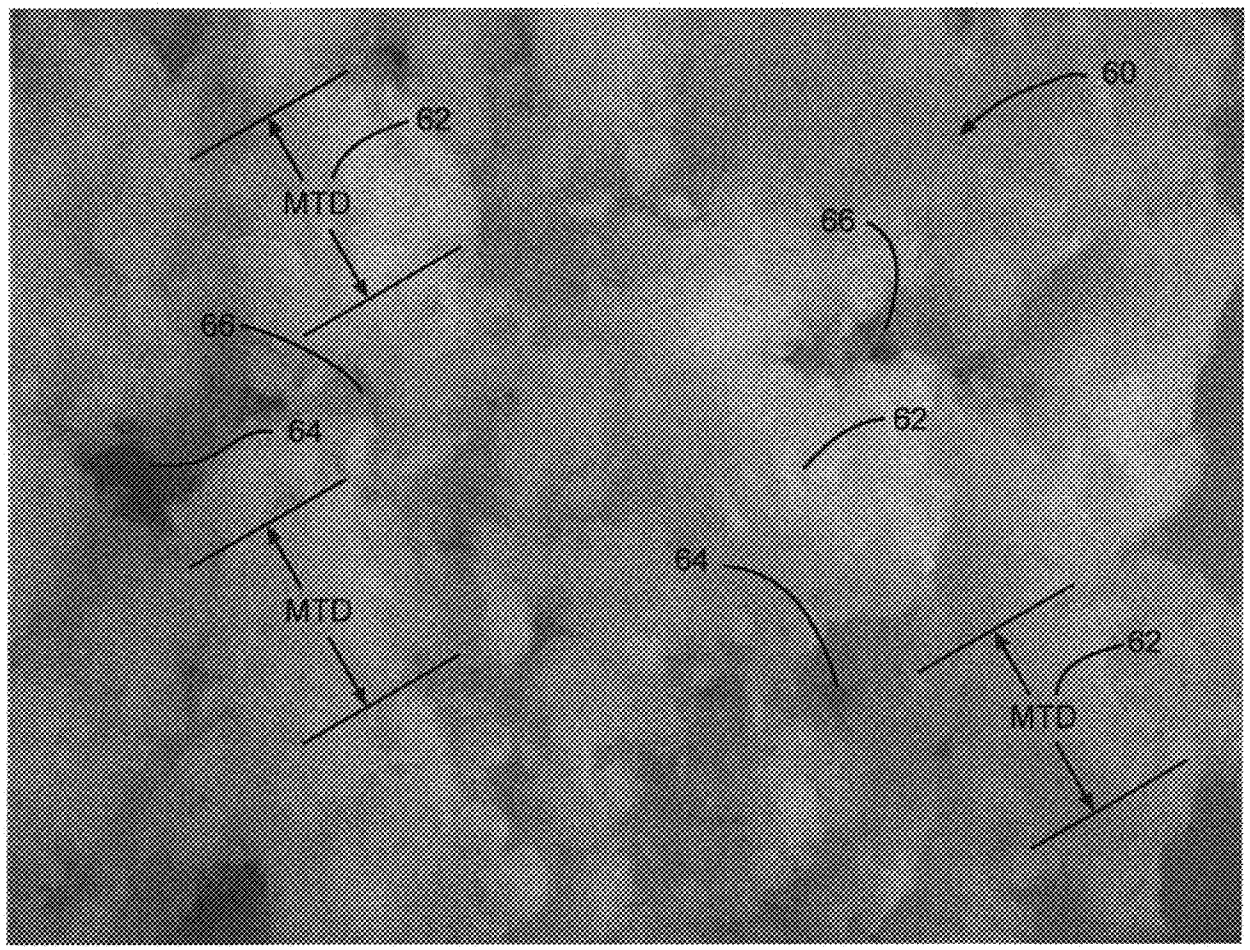
FIG. 5 is an enlarged color photograph illustrating one embodiment of an unbonded loosefill insulation material.

Referring now to FIG. 5, a sample of finely conditioned loosefill material is illustrated generally at 60. The sample of finely conditioned loosefill material 60 has been conditioned by the loosefill blowing machine 10 and distributed into the airstream 33. For purposes of clarity, the sample of the loosefill material 60 has been magnified by an approximate factor of 2×. The loosefill material 60 has been conditioned by the blowing wool machine 10 illustrated in FIGS. 1-3 and discussed above. The loosefill material 60 includes a multiplicity of individual "tufts" 62. The term "tuft", as used herein, is defined to mean any cluster of insulative fibers.

Referring again to FIG. 5, a first physical characteristic of the sample of loosefill material 60 is "voids". The term "void" as used herein, is defined to mean a space between adjoining tufts 62. The voids can be complete voids 64, meaning the absence of any loosefill material fibers in the space between the adjacent tufts, 62, or partial voids 66, meaning a minimal amount of loosefill material fibers in the space between the adjacent tufts 62. Complete voids 64 and partial voids 66 are illustrated in FIG. 5. The voids, 64 and 66, have a void size, a void frequency of occurrence and a void distribution. The term "void size", as used herein, is defined to mean the average length of the space between adjoining tufts 62. The term "void frequency of occurrence", as used herein, is defined to mean the number of void occurrences per volumetric measure. The term "void distribution", as used herein, is defined to mean the grouping or degree of concentration of the voids per volumetric measure. The void size, void frequency of occurrence and void distribution of the voids, 64 and 66, are some of the factors that determine the insulative value ("R value") of the finely conditioned loosefill material 60. The term "R value", as used herein, is defined to mean a measure of thermal resistance and is usually expressed as $ft^2 \cdot {}^\circ F. \cdot h/Btu$.

As shown in FIG. 5, the void size of the loosefill material 60 is in a range of from about 2.5 mm to about 7.6 mm. The void frequency of occurrence of the loosefill material 60 is in a range of from about 1.0 per cubic centimeter to about 2.0 per cubic centimeter. The void distribution within the loosefill material 60 is in a range of from about 1.0 per cubic centimeter to about 2.0 per cubic centimeter. It is believed that the loosefill material 60 has relatively smaller, less frequent and more evenly distributed voids than the voids of conventional unbonded loosefill insulation (not shown) by an amount within a range of from about 10% to about 30%. Without being bound by the theory, it is believed that the relatively smaller, less frequent and more evenly distributed voids of the loosefill material 60 contribute to an improved insulative value.

The void size, void frequency of occurrence and void distribution of the voids, 64 and 66, can be measured by various image analysis techniques. The term "image analysis", as used herein, is defined to mean the extraction of meaningful information from images, including digital images. In some instances, the image analysis techniques can include x-ray computed tomography, optical microscopy and magnetic resonance imaging. In other instance, higher resolution imaging can be employed with electron microscopy.

As further shown in FIG. 5, another physical characteristic of the tufts 62 is an average "major tuft dimension" MTD. The term "major tuft dimension", as used herein, is defined to mean the average length of a tuft 62 along its longest segment. The major tuft dimension MTD can be another determinative factor of the insulative value of the loosefill material 60. In the illustrated embodiment, the tufts 62 have a "major tuft dimension" MTD in a range of from about 2.5 mm to about 7.6 mm. It is believed that the major tuft dimension MTD of the loosefill material 60 is relatively shorter than the major tuft dimension of conventional unbonded loosefill insulation (not shown) by an amount within a range of from about 10% to about 30%. Without being bound by the theory, it is believed that the shorter major tuft dimension MTD of the loosefill material 60 contributes to an improved insulative value. The major tuft dimension MTD can be measured using the various image analysis techniques discussed above.

Referring again to FIG. 5, another physical characteristic of the tufts 62 is a "tuft density". The term "tuft density", as used herein, is defined to mean the weight of the loosefill material 60 per volumetric measure of tuft 62. As shown in FIG. 5, the tuft density of the tufts 62 can be relatively dense as visually observed from the apparent compaction of the loosefill material 60 within the tufts 62. The tuft density can be another determinative factor of the insulative value of the loosefill insulation 60. In the illustrated embodiment, the tuft density of the tufts 62 is in a range of from about 4.0 kilograms per cubic meter to about 11.2 kilograms per cubic meter. It is believed that the tuft density of the loosefill material 60 is relatively less than the tuft density of conventional unbonded loosefill insulation (not shown) by an amount within a range of from about 10% to about 30%. Without being bound by the theory, it is believed that the lesser tuft density of the loosefill material 60 contributes to an improved insulative value. The tuft density can be measured using the various image analysis techniques discussed above.

Figure 6:
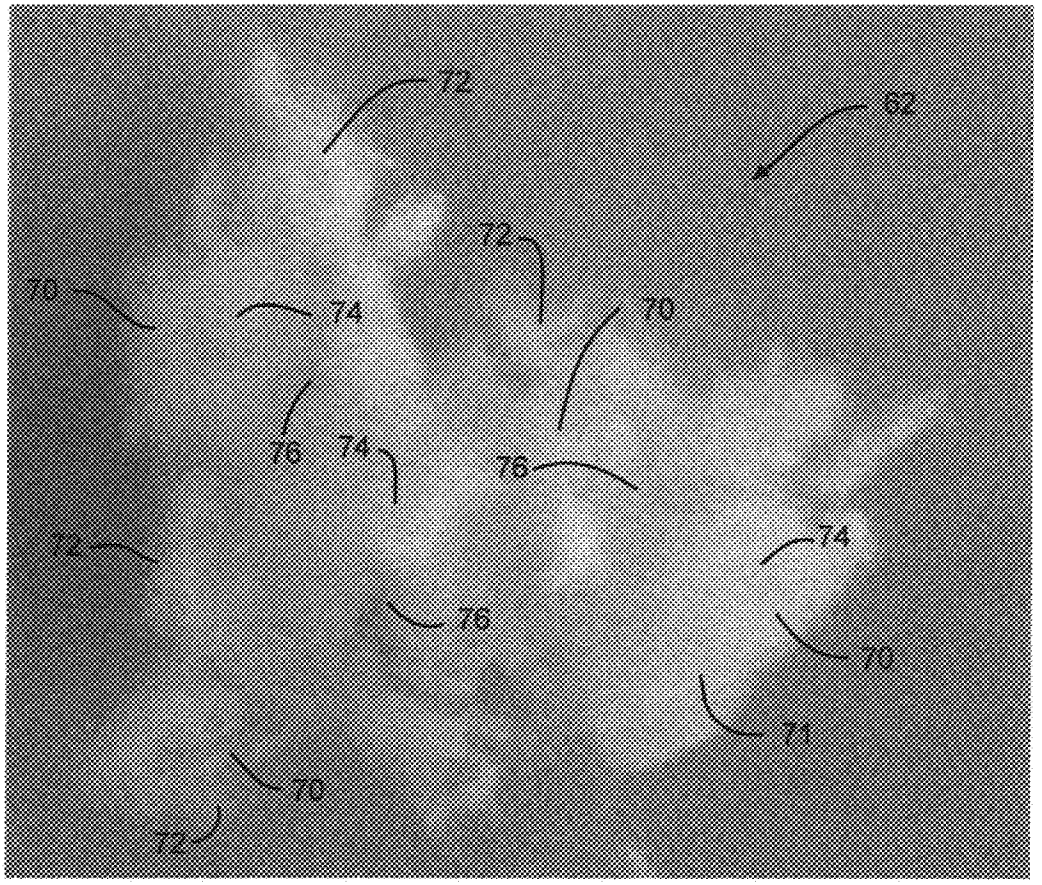
FIG. 6 is an enlarged color photograph illustrating an individual tuft of the unbonded loosefill insulation material of FIG. 5.

Referring now to FIG. 6, an individual tuft 62 of the loosefill material 60 is illustrated. For purposes of clarity, the individual tuft 62 has been magnified by an approximate factor of 8×. Another physical characteristic of the tuft 62 is a plurality of irregularly-shaped projections 70 extending from an outer surface 71 of the tuft 62. The term "projection', as used herein, is defined to mean any bump, protrusion or extension of the outer surface 71 of the tuft 62. The percentage of the outer surface 71 of the tuft 62 having irregularly-shaped projections 70 can be another determinative factor of the insulative value of the loosefill material 60. As shown in FIG. 6, the outer surface 71 of the tuft 62 has irregularly-shaped projections 70 in an amount in the range of from about 50% to 80%. It is believed that the percentage of irregularly-shaped projections 70 extending from the outer surface 71 of the tuft 62 of the loosefill material 60 is relatively greater than the percentage of irregularly-shaped projections extending from the outer surface of a tuft of conventional unbonded loosefill insulation (not shown) by an amount within a range of from about 10% to about 30%. Without being bound by the theory, it is believed that the higher percentage of irregularly-shaped projections 70 extending from the surface 71 of the tuft 62 of the loosefill material 60 contributes to an improved insulative value. The percentage of irregularly-shaped projections 70 extending from the surface 71 of the tuft 62 can be measured using the various image analysis techniques discussed above.

Referring again to FIG. 6, another physical characteristic of the tuft 62 is a plurality of "hairs" 72 extending from the irregularly-shaped projections 70 of the tuft 62. The term "hairs", as used herein, is defined to mean any portion of the insulation fibers extending from the irregularly-shaped projections 70. While the hairs 72 are shown in FIG. 6 as extending from the irregularly-shaped projections 70 and into space, it should be appreciated that the hairs 72 can also extend from the irregularly-shaped projections 70 into the body of the tuft 62. The quantity of irregularly-shaped projections 70 having hairs extending therefrom can be another determinative factor of the insulative value of the loosefill material 60. In the embodiment shown in FIG. 6, the quantity of irregularly-shaped projections 70 having extending hairs 72 is in a range of from about 60% to about 80%. It is believed that the tufts 62 of the loosefill material 60 have relatively more hairs 72 extending from irregularly-shaped projections 70 than conventional unbonded loosefill insulation by an amount in a range of from about 10% to about 30%. Without being bound by the theories, it is believed that the increased quantity of the hairs 72 of the tuft 62 contribute to an improved insulative value (R) for several reasons. First, it is believed that the hairs 72 extend into the voids, 64 and 66 as shown in FIG. 5, thereby partially filling the voids, which contributes to the ability of the loosefill material 60 to reduce radiation heat transfer between the tufts 62. Second, it is believed that the extended hairs 72 contribute in maintaining a separation between the tufts 62, which can substantially prevent an increased density of the loosefill material 60. The percentage of the irregularly-shaped projections 70 having extending hairs 72 can be measured using the various image analysis techniques discussed above.

Referring again to FIG. 6, the tuft 62 includes a multiplicity of fibers 74 arranged in a random orientation. The term "fibers", as used herein, is defined to mean any portion of the loosefill material 60. A sixth physical characteristic of the tufts 62 is "gaps" 76. The term "gaps" as used herein, is defined to mean a portion of the tuft 62 having a lighter density than other portions of the tuft 62. The gaps 76 have a gap size, a gap frequency of occurrence and a gap distribution. The gap size, gap frequency of occurrence and gap distribution are additional factors that can determine the insulative value ("R value") of the loosefill material 60.

The term "gap size", as used herein, is defined to mean the average length of the portion of the tuft 62 having a lighter density. The term "gap frequency of occurrence", as used herein, is defined to mean the number of gap 76 occurrences per volumetric measure. The term "gap distribution", as used herein, is defined to mean the grouping or concentration of the gaps 76 per volumetric measure. As shown in FIG. 6, the gap size of the loosefill material 60 is in a range of from about 1.2 mm to about 2.5 mm. The gap frequency of occurrence of the loosefill material 60 is in a range of from about 3.0 to about 5.0 per cubic centimeter. The gap distribution within the loosefill material 60 is in a range of from about 3.0 to about 5.0 per cubic centimeter. It is believed that the loosefill material 60 has relatively larger, more frequent and more evenly distributed gaps than the gaps of conventional unbonded loosefill insulation (not shown) by an amount within a range of from about 10% to about 30%. Without being bound by the theory, it is believed that the relatively larger, more frequent and more evenly distributed gaps of the loosefill material 60 contribute to an improved insulative value (R). The gap size, gap frequency of occurrence and gap distribution of the tufts 62 can be measured using the various image analysis techniques discussed above.

Referring again to FIG. 6, another physical characteristic of the tuft 62 is a generally cubic shape. The term "cubic", as used herein, is defined to mean having a shape more in the form of a cube. The generally cubic shape of the tuft 62 results in more cubic consistency. The term "cubic consistency", as used herein, is defined to mean the percentage of an object that fills a cubically-shaped volume. As shown in FIG. 6, the tufts 62 fill a cubically-shaped volume in a range of from about 40% to about 80%. It is believed that the tuft 62 of the unbonded loosefill insulation 60 has relatively more cubic consistency than conventional loosefill insulation by an amount in a range of from about 10% to about 30%. Without being bound by the theory, it is believed that the increased cubic consistency of the tuft 62 contributes to an improved insulative value of the loosefill material 60. It is believed that the cubic consistency of the tufts 62 allows the tufts 62 to "nest" at an optimum level. The term "nest", as used herein, is defined to mean the close fitting together of a plurality of tufts 62. It is believed that an optimum level of nesting by the tufts 62 provides an optimum insulative value of the loosefill material 60. In contrast, tufts 62 that nest too much, too close together, result in an unacceptably high density level of the improved loosefill insulation 60. Tufts 62 that nest too little result in an unacceptably poor insulative value. Accordingly, the increased cubic consistency of the tufts 62 provides a balance between the density of the loosefill material 60 and the insulative value of the loosefill material 60. The cubically-shaped volume of the tufts 62 can be measured using the various image analysis techniques discussed above.

The physical characteristics discussed above for the finely conditioned loosefill material 60 and the tufts 62 contribute to an "open structure". That is, the voids, 44 and 46, major tuft dimension MTD, tuft density, irregularly-shaped projections 70, extended hairs 72 and gaps 76 cooperate to form an "open structure" for the loosefill material 60. The term "open structure", as used herein, is defined to mean a relatively porous structure incorporating relatively numerous and large gaps or voids. Conversely, the physical characteristics discussed above for the conventional loosefill insulation typically combine to form a relatively "closed structure". The term "closed structure", as used herein, is defined to mean a more definitively defined boundary enclosing densely oriented fibers forming relatively few and small voids and gaps. It is believed the open structure of the loosefill material 60 provides an improved insulative value.

While the sample loosefill material illustrated in FIGS. 5-6 are believed to be representative of the loosefill material 60, it is to be understood that variations among samples may occur.

As discussed above, the operating parameters of the loosefill blowing machine 10 are tuned to the insulative characteristics of the associated unbonded loosefill insulation material such that the resulting blown loosefill insulation material provides improved insulative values. The operating parameters of the loosefill blowing machine can include the flow rate of the finely conditioned loosefill material 60 through the loosefill blowing machine 10 and the flow rate of the airstream 33 through the loosefill blowing machine 10. As further discussed above, the flow rate of the finely conditioned loosefill material 60 through the loosefill blowing machine 10 is fixed by the fixed rotational speed of the low speed shredders, 24*a* and 24*b*, the agitator 26 and the discharge mechanism 28. The flow rate of the airstream 33 through the loosefill blowing machine 10 is fixed by the fixed rotational speed of the blower 36. By fixing the operating parameters of the loosefill blowing machine 10, the loosefill blowing machine 10 advantageously provides no operating parameter adjustments to the machine user. Accordingly, the operating parameters of the loosefill blowing machine 10 are pre-set for the machine user. The pre-set and fixed operating parameters of the loosefill blowing machine 10, coupled with the insulative characteristics of the associated unbonded loosefill insulation material 60, result in an integrated system configured to provide blown loosefill material having desired and improved insulative values.

In one embodiment, the results of the pre-set and fixed operating parameters of the loosefill blowing machine 10, coupled with the loosefill material 60 described above, provide the improved insulative characteristics of the resulting blown insulation material as shown in Table 1.

TABLE 1

| (R) Thermal Resistance ($ft^2 \cdot °F. \cdot h/Btu$) | Thickness (T = R * k) (inches) | Weight ($lbs/f^2$) | Number of Bags Per 1k $f^2$ | Coverage ($ft^2/bag$) | Density ($lbs/ft^3$) | (k) Thermal Conductivity ($Btu\text{-}in/(hr \cdot ft^2 \cdot °F.)$) |
|---|---|---|---|---|---|---|
| 60 | 19.25 | 0.882 | 30.9 | 32.3 | 0.550 | 0.321 |
| 49 | 16.00 | 0.697 | 24.5 | 40.9 | 0.523 | 0.327 |
| 44 | 14.50 | 0.617 | 21.6 | 46.2 | 0.510 | 0.330 |
| 38 | 12.75 | 0.527 | 18.5 | 54.1 | 0.496 | 0.336 |
| 30 | 10.25 | 0.406 | 14.2 | 70.2 | 0.475 | 0.342 |
| 26 | 9.00 | 0.349 | 12.2 | 81.8 | 0.465 | 0.346 |
| 22 | 7.75 | 0.293 | 10.3 | 97.1 | 0.454 | 0.352 |
| 19 | 6.75 | 0.251 | 8.8 | 113.6 | 0.446 | 0.355 |
| 13 | 4.75 | 0.170 | 6.0 | 167.7 | 0.429 | 0.365 |
| 11 | 4.00 | 0.141 | 4.9 | 202.0 | 0.423 | 0.364 |

The thermal resistance (R) and density, as shown in Table 1, are determined in accordance with Standard Practice ASTM C687 and Standard Test Methods ASTM 518 and ASTM 1574. These ASTM Standards provide a laboratory guide to determine the thermal resistance and density of loose-fill building insulations at mean temperatures between −20 and 55° C. (−4 to 131° F.). These Standards apply to a wide variety of loose-fill thermal insulation products including fibrous glass, rock/slag wool, or cellulosic fiber materials; granular types including vermiculite and perlite; pelletized products; and any other insulation material installed pneumatically or poured in place.

It should be understood that the values provided in Table 1 are presented in compliance with the requirements of 16 C.F.R. Part 460 titled "Labeling and Advertising of Home Insulation" (also known as the "R-Value Rule").

As shown in Table 1, the thermal resistance (R) of the resulting blown insulation material 60 can be varied by varying the Thickness. As one specific example of the improved insulative characteristic, a thermal resistance (R) of 30 having a thickness of 10.25 inches can be achieved with as few as 14.2 bags of compressed insulation material. The resulting Density of the resulting blown insulation material 60 advantageously is reduced to 0.475 and the thermal conductivity is also advantageously reduced to 0.342.

While the specific example discussed above is based on a thermal resistance (R) value of 30, it should be noted that Table 1 advantageously includes similar improvements for other values of thermal resistance (R).

While the discussion above has been focused on pre-setting and fixing the operating characteristics of the loosefill blowing machine 10 by fixing the flow rate of the finely conditioned loosefill material 60 through the loosefill blowing machine 10 and the flow rate of the airstream 33 through the loosefill blowing machine 10, it should be appreciated that in other embodiments, other operating parameters of the loosefill blowing machine 10 can be coupled with the insulative characteristics of the associated unbonded loosefill insulation material to provide improved insulative characteristics of the resulting blown insulation material. As one example, the quantity of shredders, 24*a* or 24*b*, or agitators 26 can be increased. As another example, the shredding characteristics of the shredders, 24*a* or 24*b*, or the conditioning characteristics of the agitator 26 can be changed. In still other embodiments, the flow of the loosefill material 60 through the loosefill blowing machine 10 can be altered such that the loosefill material 60 is subjected to additional conditioning.

Summarizing, an unbonded loosefill insulation system is formed by the coupling of a loosefill blowing machine, having fixed operating parameters, and an associated unbonded loosefill insulation material. The fixed operating parameters of the loosefill blowing machine are tuned to the insulative characteristics of the associated unbonded loosefill insulation material such that the resulting blown unbonded loosefill insulation material provides improved insulative values.

The principle and methods of assembly of the insulation blowing system have been described in its preferred embodiments. However, it should be noted that the insulation blowing system may be practiced otherwise than as specifically illustrated and described without departing from its scope.

What is claimed is:

1. A method of providing blown loosefill insulation material comprising the steps of:

providing an unbonded loosefill insulation system including a blowing insulation machine configured to condition and distribute loosefill insulation from a package of compressed loosefill insulation, the blowing insulation machine further configured to have pre-set and fixed operating parameters and an unbonded loosefill insulation material configured for use with the blowing insulation machine, the unbonded loosefill insulation material having insulative characteristics;

fixing the operating parameters of the blowing insulation machine;

feeding the unhanded loosefill insulation material into the blowing insulation machine;

conditioning the unbonded loosefill insulation material within the blowing insulation machine; and distributing the conditioned unhanded loosefill insulation material into an airstream;

wherein the pre-set and fixed operating parameters of the blowing insulation machine are tuned to combine with the insulative characteristics of the unbonded loosefill insulation materials to provide blown loosefill insulation material having the insulation manufacturer's prescribed insulative values at specific layer thicknesses.

2. The method of claim 1, including the step of providing a plurality of shredders, a discharge mechanism and a blower within the blowing insulation machine, and wherein the plurality of shredders, discharge mechanism and blower are configured to operate on a single 15 ampere, 110 volt a.c. power supply.

3. The method of claim 1, wherein the pre-set and fixed operating parameters include a flow rate of conditioned loosefill insulation material through the blowing insulation machine and a flow rate of an airstream through the blowing insulation machine.

4. The method of claim 3, wherein the flow rate of conditioned loosefill insulation material is fixed by fixing the rotational speed of a first drive system and the flow rate of airstream is fixed by fixing the rotational speed of a second drive system.

5. The method of claim 1, wherein an average length between tufts of the unbonded loosefill insulation material is in a range of from about 2.5 mm to about 7.6 mm.

6. The method of claim 1, wherein the unbonded loosefill insulation material has a plurality of tufts, and wherein the tufts have a density in a range of from about 4.0 kilograms per cubic meter to about 11.2 kilograms per cubic meter.

7. The method of claim 1, wherein the unbonded loosefill insulation material has a plurality of tufts, and wherein the tufts have a tuft gap size, a tuft gap frequency of occurrence and a tuft gap distribution, and wherein the tuft gap size is in a range of from about 1.2 mm to about 2.5 mm, the tuft gap frequency of occurrence is in a range of from about 3.0 to about 5.0 per cubic centimeter and the tuft gap distribution is in a range of from about 3.0 to about 5.0 per cubic centimeter.

8. The method of claim 1, wherein the unbonded loosefill insulation material has a plurality of tufts, and wherein the tufts are configured to fill a cubically-shaped volume in a range of from about 40% to about 80%.

9. The method of claim 1, wherein the blown loosefill insulation provides an insulative value (R) of 30 $ft^2 \cdot {}^\circ F. \cdot h/Btu$, at a thickness of 10.25 inches, a density of 0.475 $lbs/ft^3$ and a thermal conductivity of 0.342 $Btu\text{-}in/(hr \cdot ft^2 \cdot {}^\circ F.)$.

* * * * *